United States Patent [19]

Taniwaki

[11] 4,211,039

[45] Jul. 8, 1980

[54] DOOR ASSEMBLY

[75] Inventor: Genshi Taniwaki, Kumamoto, Japan

[73] Assignee: Kongo Co., Ltd., Japan

[21] Appl. No.: 906,740

[22] Filed: May 17, 1978

[51] Int. Cl.[2] ..... E05F 11/00

[52] U.S. Cl. ..... 49/361; 49/425; 109/73

[58] Field of Search ..... 49/360–363, 49/404, 425, 209, 211, 212, 254, 257, 260, 221, 409–412, 231, 477; 109/73, 69

[56] References Cited

U.S. PATENT DOCUMENTS

| | | | |
|---|---|---|---|
| 909,552 | 1/1909 | Conner | 49/361 X |
| 2,445,131 | 7/1948 | Wartian | 49/212 X |
| 2,722,413 | 11/1955 | Coors | 49/221 |
| 2,979,328 | 4/1961 | Henrikson | 49/361 |
| 3,146,500 | 9/1964 | Volkert | 49/449 X |
| 3,426,480 | 2/1969 | Dzamba | 49/410 |
| 3,913,268 | 10/1975 | Paterson | 49/360 X |

FOREIGN PATENT DOCUMENTS

| | | | |
|---|---|---|---|
| 841437 | 7/1960 | United Kingdom | 49/212 |

*Primary Examiner*—Philip C. Kannan
*Attorney, Agent, or Firm*—McGlew and Tuttle

[57] ABSTRACT

A door assembly including a door associated with a guide which is disposed in an orientation perpendicular to the plane of a door opening formed in a wall, and a guide follower mounted on the door to run along the guide. In one embodiment the guide follower is rotatably driven by the rotation of a handle mounted on the door through a transmission. In another embodiment, the door may be manually pushed or pulled along the guide.

12 Claims, 12 Drawing Figures

DOOR ASSEMBLY

BACKGROUND OF THE INVENTION

The invention relates to a door assembly which may be used with an inlet opening of a money-custody vault or safe, for example.

Conventional door assemblies installed at the inlet/-outlet gate of a vault or safe are either of a hinged type in which the door is pivotally mounted along its one lateral edge or of a sliding type in which the door runs parallel to the plane of the inlet opening. In either known type, when the inlet/outlet opening is open, the door is laterally removed from the opening, thereby allowing the internal construction and disposition of the vault or safe to be exposed to the view from the outside to would be burglars or thieves. This leads to the disadvantage of affording opportunities to such burglars in a bank which is frequented by many visitors to study and learn the details of the internal portions of such vault or safe.

OBJECTS

It is an object of the invention to provide a door assembly in which a door is located in front of an inlet/-outlet opening of a safe when the latter is open so as to avoid viewing of the interior of a safe from the outside of a safe which is to be closed by the assembly, thus reducing the chance of visual access to the interior of such safes.

It is another object of the invention to provide a door assembly in which a door is constructed to be readily operated with a force of a reduced magnitude.

SUMMARY OF INVENTION

In accordance with the invention, the door assembly comprises a guide means disposed in an orientation perpendicular to the plane of an opening formed in a wall, a door adapted to be fitted into the opening, and a runner or guide follower on the door for running the door along the guide means. Thus the door is movable in a direction perpendicular to the plane of the opening so as to be fit into or moved out of the opening. A handle is provided on the door, whereby the turning force applied to the handle is transmitted to the runner or guide follower through a transmission mechanism.

With the present invention, when the door is moved away from the opening in the wall, it continues to be located forwardly of or in front of the opening, thus preventing a view of the interior of a safe from the exterior thereof. Thus when the door assembly is installed in the access opening of the money-custody vault or safe of a bank, it avoids any chance or opportunity for burglars to view the internal structure of the safe. The transmission of the rotation of the handle to the runner or guide follower through the transmission means enables a door of substantial weight to be moved in a facilitated manner with a minimum of effort.

DETAILED DESCRIPTION OF PREFERRED EMBODIMENTS

Figure 1:
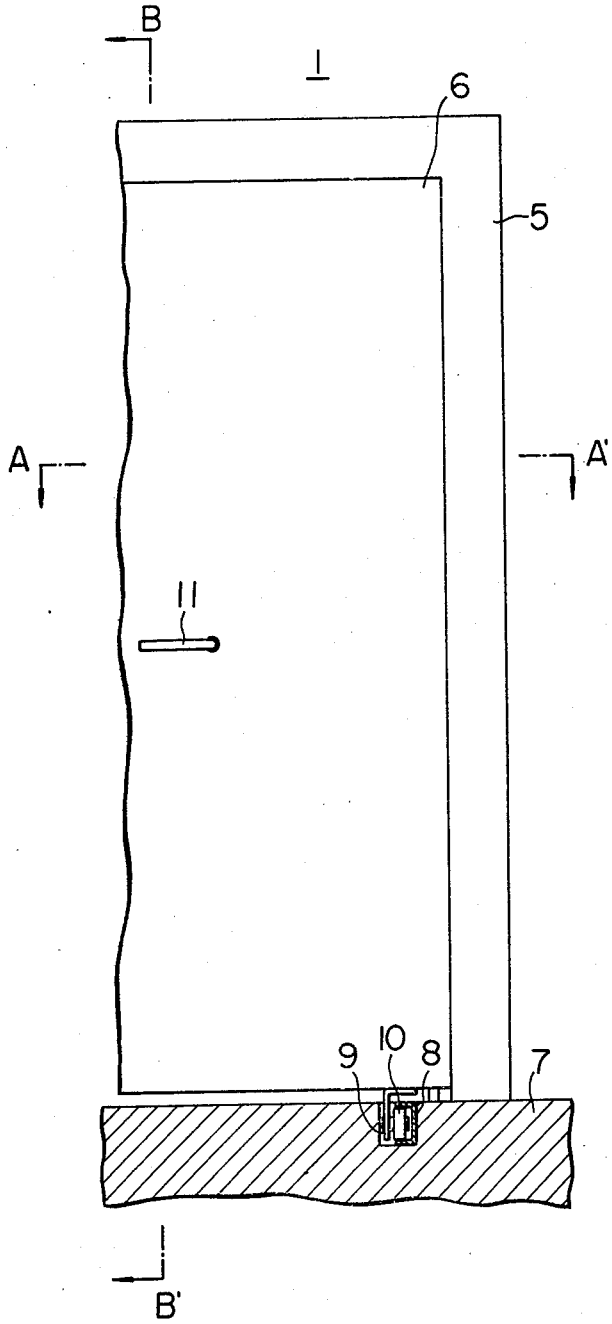
FIG. 1 is a front view of a portion of an embodiment of the invention.

Referring to FIGS. 1 to 5, there is shown a wall 1 which defines a partition between the interior 2 and the exterior 3 of a money-custody vault or safe. A rectangular opening 4 is formed in the wall 1 which is of a size to permit a free access and/or of personnel into and out of the interior 2. A metal door frame 5 is secured to the top, bottom and both side walls of the opening 4. Buried in a floor 7, there are a pair of channel-shaped rails 8 with their open side facing toward each other. The rails 8 start from a position immediately below the opening 4 and extend to a position forwardly thereof in parallel relationship with each other and in a direction perpendicular to the plane of the wall 1. The groove in which each rail 8 is disposed is of a width which slightly exceeds that of the rail, leaving a certain clearance on the open side of the rail 8. Wheels 10 associated with a door 6 rest on the inner surface of the lower limb of the rails 8. A pair of angled wheel bearings 9 are secured to the bottom surface of the door 6 and extend in a direction perpendicular to the plane thereof. The wheels 10 are mounted on the vertical part of the bearings so as to be rotatable in a vertical plane. It will be noted that the vertical part which supports the wheels is received in the clearance formed adjacent the open side of the channels when the wheels are placed on the lower limb of the rails 8. Wheels 10 can be placed in this manner by introducing them into the space within the rails through a notch suitably formed in the upper limb thereof. The bearings 9 have a length which exceeds the thickness of the door 6, and a pair of wheels 10 are journalled on the opposite ends of each bearing. Thus a total of four wheels permit the door 6 to be moved along the rails 8 and to be self-standing. The surface of the door 6 is provided with a covering of metal material, which is internally filled with a filler such as concrete, for example. All around its four sides, the peripheral surface of the door 6 is stepped to make the door 6 have a close fit with the door frame 5 when the door is in the closed position of the opening 4 formed in the wall 1. A handle 11 projects forwardly from the front surface of the door 6 in the central region thereof.

Figure 2:
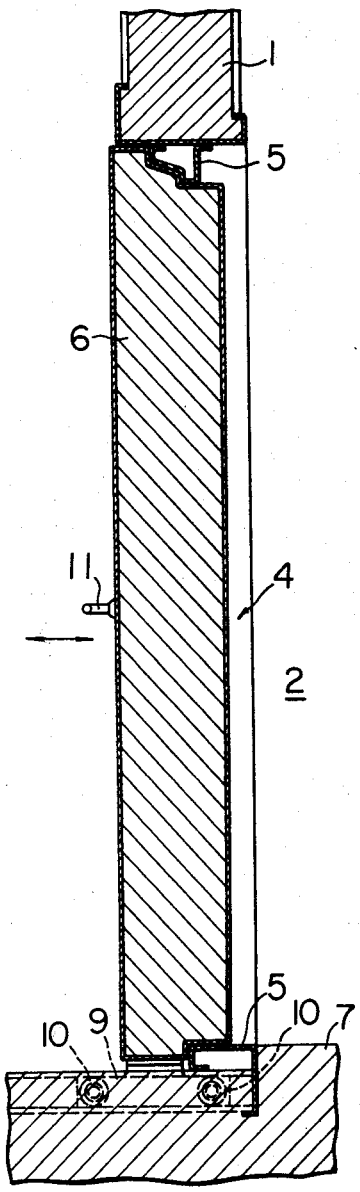
FIG. 2 is a cross section taken along the line B—B' shown in FIG. 1.
Figure 3:
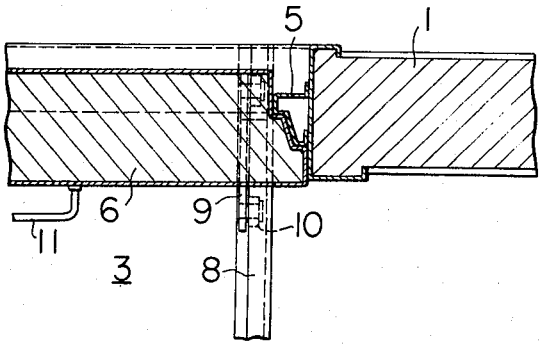
FIG. 3 is a cross section taken along the line A—A' shown in FIG. 1.
Figure 9:
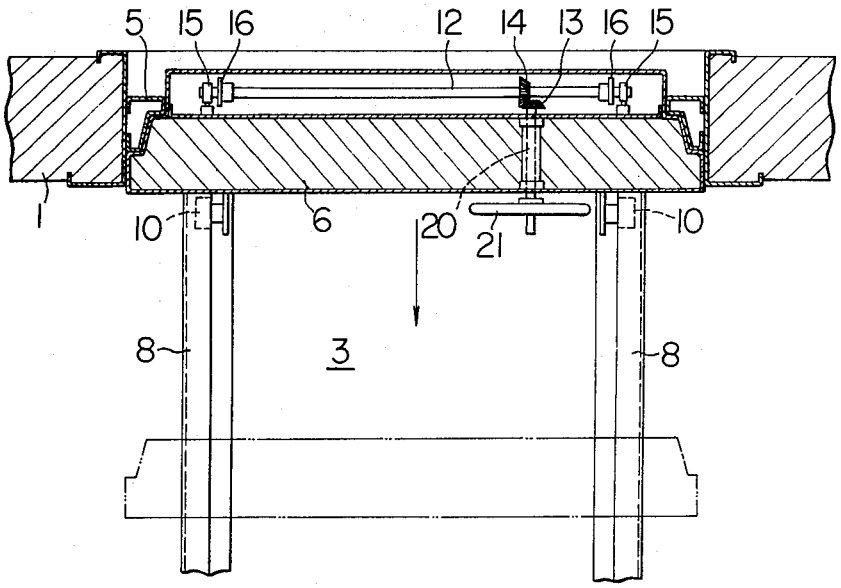
FIG. 9 is a cross section taken along the line IX—IX shown in FIG. 8.
Figure 4:
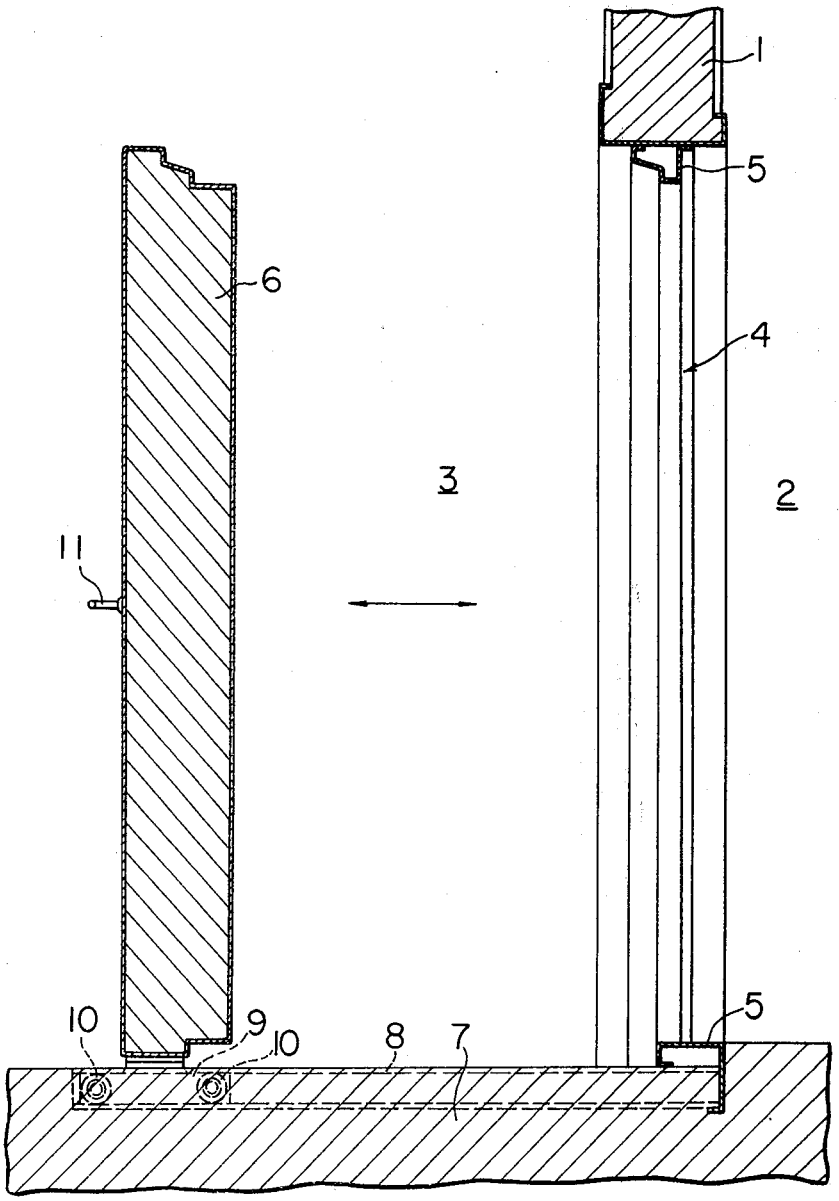
FIG. 4 is an elevational section illustrating the door in its open position.
Figure 5:
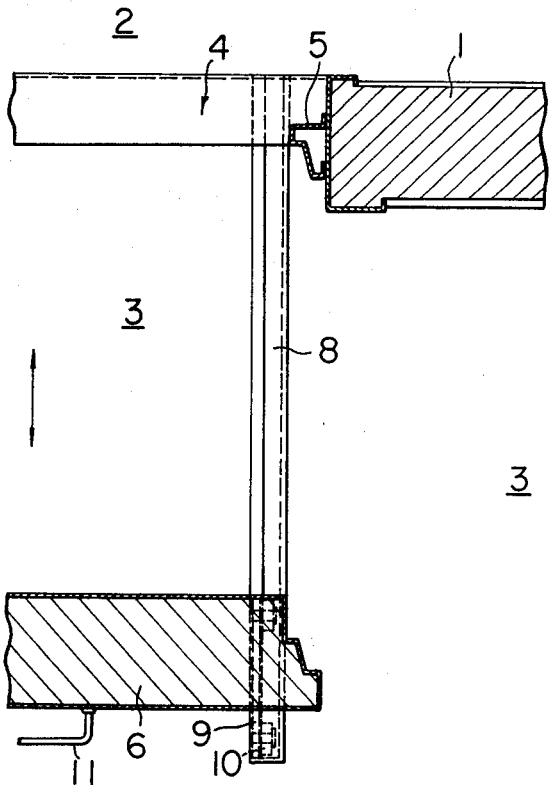
FIG. 5 is a partial plan view of the door shown in FIG. 4.
Figure 10:
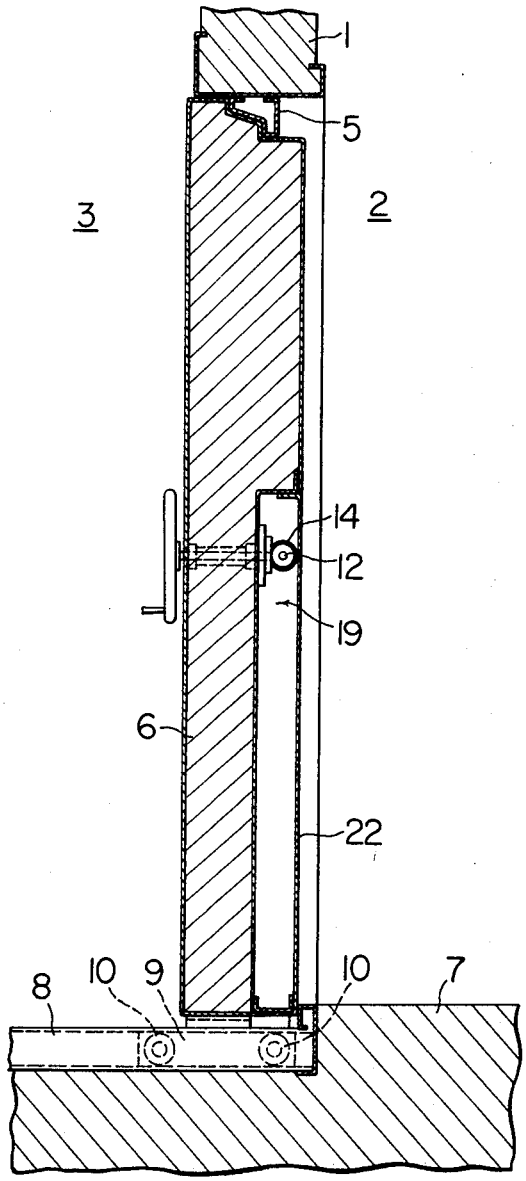
FIG. 10 is a cross section taken along the line X—X shown in FIG. 8.

When it is desired to move the door 6 from its closed position shown in FIGS. 2 and 3 in which it closes the opening 4, the handle 11 is grasped and pulled forwardly. When pulled in this manner, the door 6 moves away from the opening 4 in a direction perpendicular to the plane thereof as the wheels 10 roll on the rails 8, thus creating a space between the door 6 and the wall 1, as shown in FIGS. 4 and 5. A space of a small width will be sufficient to permit the access of personnel while a larger space may be required to permit the access of a handcart. When pulling the handle 11, an external force may be applied to the door 6 which tends to cause rotating of the door, such rotation is prevented by the abutment of the wheels 10 against the upper limb of the rails 8. When the opening 4 is to be closed, the door 6 may be pushed toward the opening 4. The wheels 10 roll on the rails 8 to bring the door 6 to its closed position shown in FIGS. 2 and 3.

Figure 6:
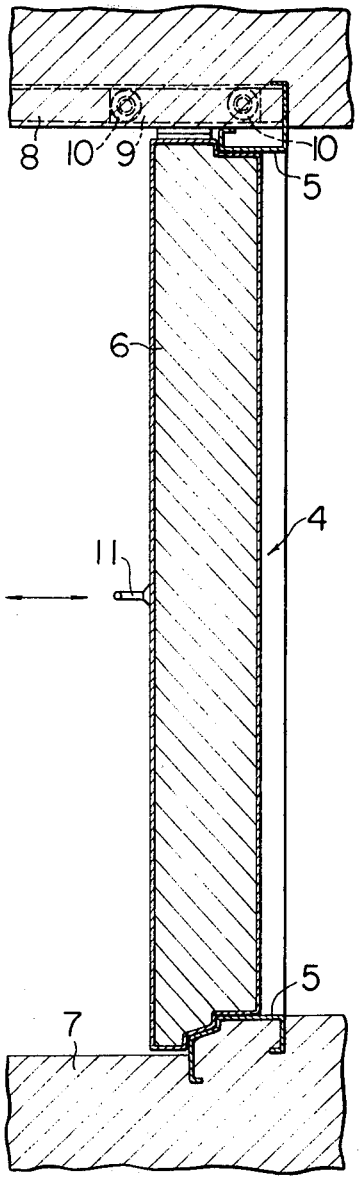
FIG. 6 is a cross section similar to FIG. 2 showing a second embodiment of the invention.

In another embodiment, the rails which help the running of the door may be disposed in the ceiling as shown in FIG. 6. Specifically, the pair of rails 8 are mounted in the ceiling so that they extend forwardly from a position directly above the opening 4, extending parallel to each other in a direction perpendicular to the plane of the wall 1. Again, the rails are disposed so that their open side faces each other. The pair of bearings 9 are secured to the top end of the door 6 and rotatably carry wheels 10 which rest on the rails 8, thus suspending the door 6 in a manner to permit its running along the rails. In all other respects, the arrangement is similar to the previous embodiment. This arrangement is advantageous in that the rails are not buried in the floor, which thus remains flat to permit the transport of articles on a cart while avoiding their vibration.

Figure 7:
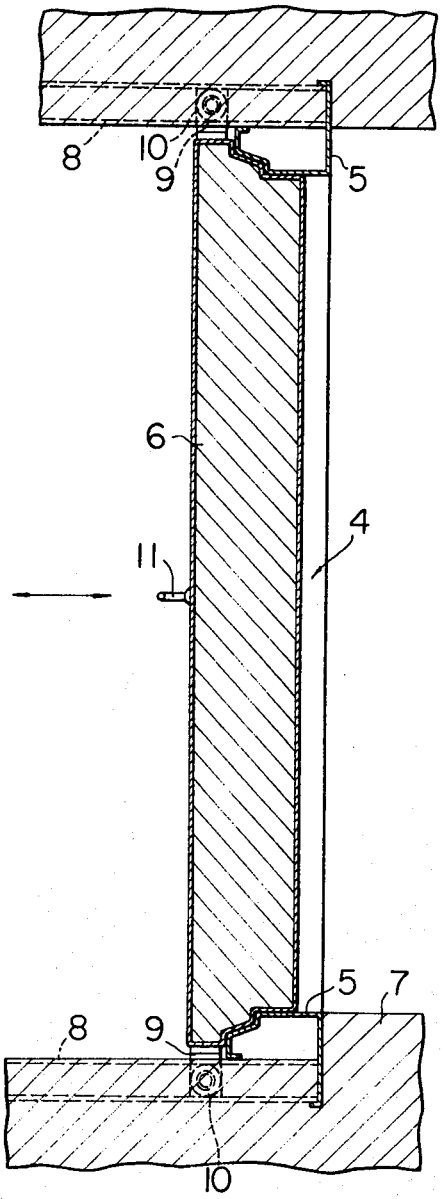
FIG. 7 is a cross section similar to FIG. 2, but showing a third embodiment of the invention.
Figure 8:
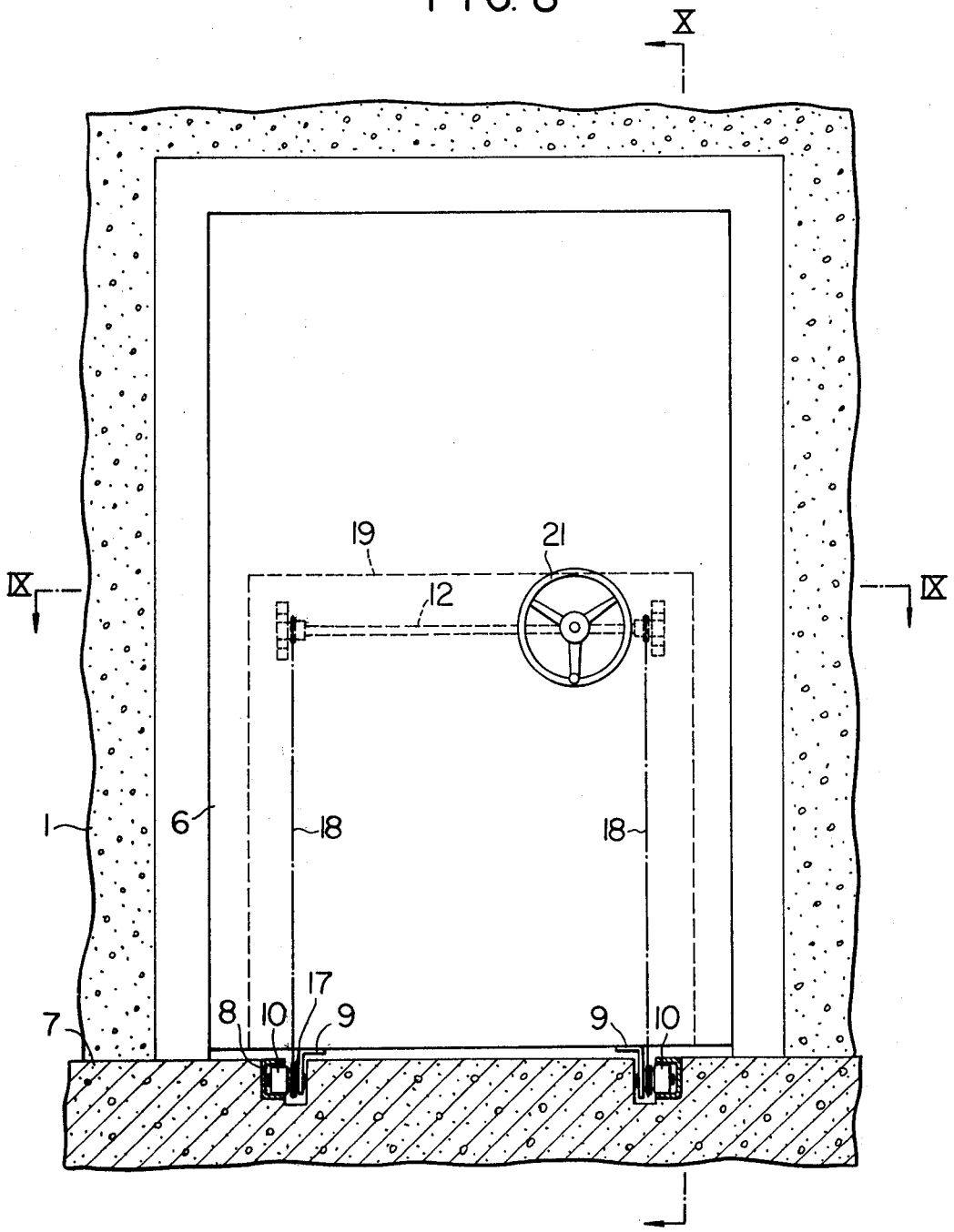
FIG. 8 is a front view of a fourth embodiment of the invention.
Figure 11:
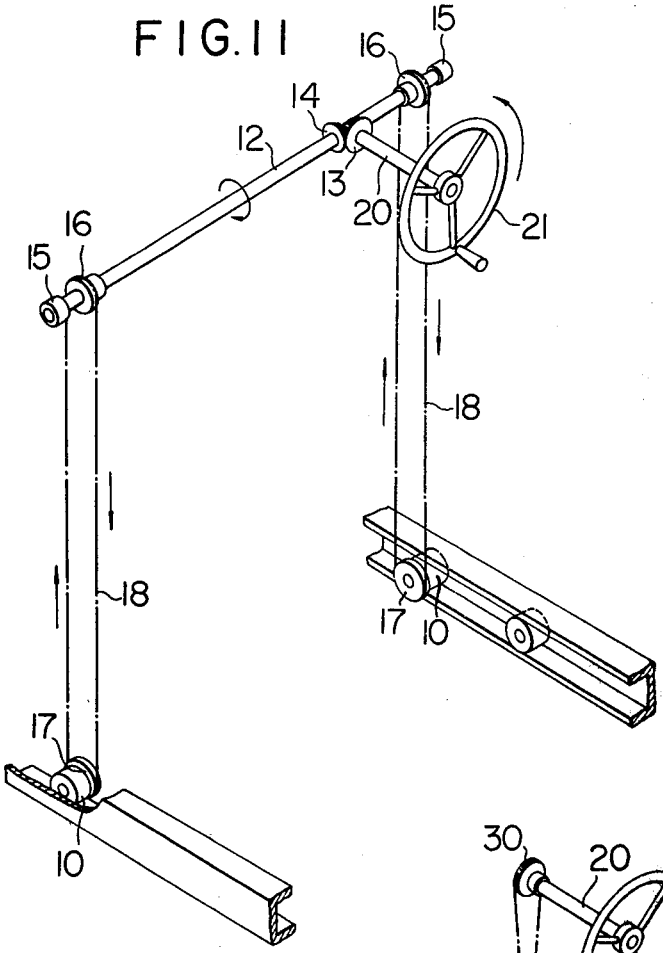
FIG. 11 is a perspective view of a power transmission mechanism employed with the fourth embodiment.

The rails which help the guiding of the door may be disposed in both the ceiling and the floor, as shown in FIG. 7, wheels 10 being rotatably carried by the top and bottom ends of the door. Since the overturn of the door 6 is prevented by the co-action between the upper and lower rails 8 and the complementary upper and lower wheels 10, only two wheels could be used on each end of the door instead of four as hereinbefore described. Such construction is preferred for a large or heavy door.

To drive the door, a rotary handle may be rotatably mounted on the front face of the door, and the rotating drive can be transmitted to the wheels through a speed reduction transmission mechanism, examples of which are shown in FIGS. 8 to 12.

Referring to FIGS. 8 to 11, a shaft 20 extends through the door 6 in the direction of its thickness at a position toward the right-hand side thereof, as viewed in front elevation, and is rotatably carried by the suitable bearings. A handle 21 is fixedly mounted on the forward end of the shaft 20 which projects from the front face thereof, while a bevel gear 13 is fixedly mounted on the rear end of the shaft 20. A pair of bearings 15, 15 are secured to the rear side of the door 6 adjacent both of the lateral edges thereof, and rotatably carry a shaft 12 in a horizontal plane which is at the same level as the shaft 20. Sprocket wheels 16, 16 are fixedly mounted on the shaft 12 adjacent its opposite ends, and another bevel gear 14 is fixedly mounted on the shaft 12 at a position which enables its meshing engagement with the bevel gear 13. Wheels 10 which are rotatably carried by the bottom of the door 6 are fixedly connected with sprocket wheels 17, 17 of a diameter greater than that of the wheels. Endless chains 18, 18 extend around the sprocket wheel 16, 16 and sprocket wheels 17, 17 which are located below the sprocket wheels 16, 16. Consequently, when the handle 21 is manually turned, the rotation thereof is transmitted to the wheels 10 through shaft 20, gears 13 and 14, shaft 12, sprocket wheels 16, 16, chains 18, 18 and sprocket wheels 17, 17, thus rotatably driving the wheels 10 to run the door 6 either forwardly or rearwardly along the rails 8. It is to be noted that the gears and sprocket wheels are dimensioned so that such a power transmission mechanism constitutes a reduction gear ratio. The majority of the transmission mechanism is received in a recess 19 formed in the lower half of the rear side of the door 6, and is protected by a metal cover plate 22, which also avoids a jamming of part of clothes with the mechanism. In other respects, the arrangement is similar to the embodiments mentioned above in connection with FIGS. 1 to 5. This embodiment facilitates the running of a heavy and large door by a manual operation since the reduction gearing transmits the rotating power of the manual handle to the wheels.

Figure 12:
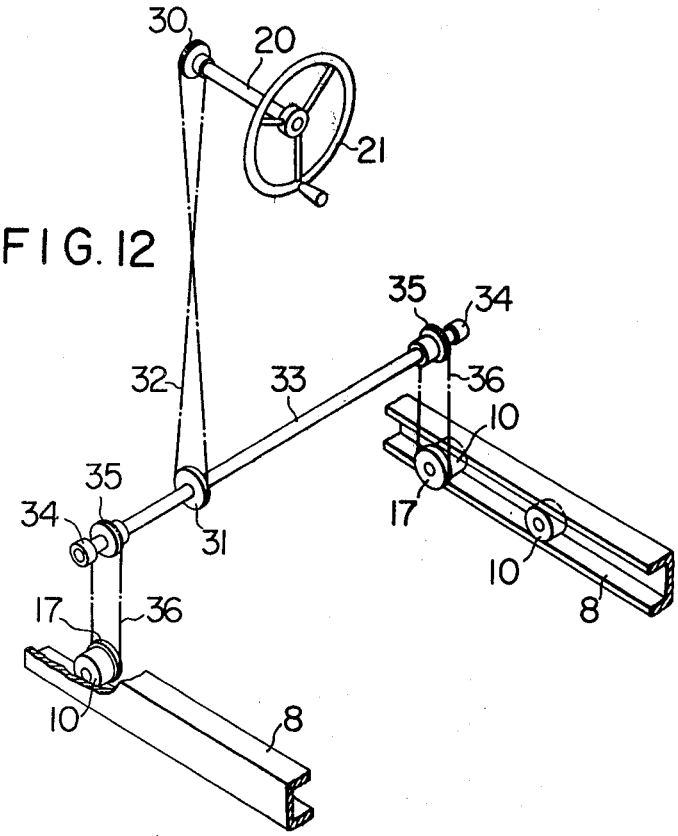
FIG. 12 is a perspective view of another form of power transmission mechanism.

FIG. 12 shows an alternative arrangement of a modified transmission having a reduction gearing. In this Figure, a sprocket wheel 30 is fixedly mounted on the rear end of the shaft 20 which is integral with the rotary handle 21. A shaft 33 is located below the sprocket wheel 30 and is rotatably supported by a pair of bearings 34 in a horizontal plane. A sprocket wheel 31 is fixedly mounted on the shaft 33 and located directly below the sprocket wheel 30, with an endless chain 32 extending around both of the sprocket wheels. A pair of sprocket wheels 35 are fixedly mounted on the shaft 33 adjacent its opposite ends, and a pair of endless chains 36 extend around the respective sprocket wheels 35 and sprocket wheels 17 on the running wheels 10. Thus, when the handle 21 is manually turned, its drive is transmitted to the wheels 10 through shaft 20, sprocket wheel 30, chain 32, sprocket wheel 31, shaft 33, sprocket wheels 35, chain 36 and sprocket wheels 17, permitting the door 6 to run either forwardly or rearwardly. Again, the parts are chosen such that the power transmission mechanism thus constructed constitutes a reduction gearing.

It will be understood that an electric or hydraulic motor or the like may be used to drive the running wheels. In either instance, the rails may be replaced by rack bars and the wheels by pinions. Alternatively, the rails may also be replaced by threaded rods and the wheels by nuts.

Finally, it will be appreciated that the described arrangement may be modified to run the door into the vault from its closed position.

What is claimed is:

1. A vault door assembly of the type used for closing the opening to a bank vault, comprising guide means disposed so as to extend in a direction normal to the plane of the opening, a door for defining a closure for said opening, guide follower means connected to said door, said guide follower means being engaged with said guide means and being disposed to follow along said guide means, said door being displaceable relative to said opening by a force acting in a direction normal thereto to move said door to an open position spaced from said opening and in a plane parallel to the plane of said opening, and by an opposite force acting normal to said door to move said door to a closed position, whereby in said open position one can enter the vault through a space between said door and said opening and whereby the interior of the vault is blocked from view by said door in its open position, drive means operatively connected to said guide follower means for driving the follower means to effect normal displacement of said door relative to said opening along said guide means, said drive means including a driver rotatably journalled to said door, a drive shaft connected to said driver, a transmission having a driven shaft, means for coupling said drive shaft and said driven shaft, and means for coupling said driven shaft to said guide follower means.

2. A door assembly as defined in claim 1 wherein said guide means are disposed at a level below said door.

3. A door assembly as defined in claim 1 wherein said guide means are disposed at a level above said door.

4. A door assembly as defined in claim 1 wherein said guide means are disposed both above and below said door.

5. A door assembly as defined in claim 1 wherein said transmission means includes a reduction gear ratio for minimizing the applied torque necessary to drive said door along said guide means.

6. A door assembly as defined in claim 1 wherein said guide means comprises a pair of spaced apart channel shaped member, said channel member having vertically spaced apart flanges; and said guide means including a roller means adapted to be received between the flanges of the respective channel members.

7. A door assembly as defined in claim 6 wherein said roller means includes a pair of spaced apart rollers, and a bracket for maintaining said rollers in said spaced apart position whereby said spaced rollers co-acting with the flanges of said rail counteract any tendency of said door to rotate.

8. A door assembly as defined in claim 1 wherein said drive shaft and said driven shaft are disposed normal to one another.

9. A door assembly as defined in claim 8 wherein said drive shaft and driven shaft are drivingly connected by meshing level gears connected to each of said respective shafts; and said coupling of said driven shaft and said guide followers comprise a endless flexible drive.

10. A door assembly as defined in claim 8 and including an endless flexible drive interconnecting said shafts in driving relationship, and a flexible endless drive interconnecting said driven shaft to said guide follower.

11. A door assembly for opening and closing the opening to a safe or vault for containing valuables comprising a door, guide means disposed relative to said opening so as to extend normally thereto, said guide means including a pair of spaced apart rails, each having opposed vertically spaced flanges, a pair of spaced apart guide followers connected to said door, said guide followers each including wheel means adapted to ride along said rails between said flanges, said door being displaced by a force relative to said opening in a direction normal thereto to an opened position spaced from said opening and in a plane parallel thereto, drive means operatively connected to said wheels for effecting the drive thereof along said rails, said drive means including a handle wheel rotatably journalled on said door, a drive shaft connected to said handle wheel, a driven shaft extending across said door in a direction normal to said drive shaft, a driving connection connecting said drive and driven shafts, said handle wheel being operated to rotate said drive shaft and said driven shaft, means connecting said driven shaft to said wheel means, said wheel means being operative along said rails to normally displace said door toward and away from said opening responsive to the operation of said hand wheel between a closed door position and an open door position in which one can pass into said vault, past said door in its open position and through said opening and in which a view of the interior of said vault is blocked by said door.

12. A door assembly as defined in claim 11 wherein the driving connection between said shafts and the means connecting said driven shaft to said wheel means define a reduction ratio so as to provide a mechanical advantage so as to effect displacement of said door relative to said opening with an optimum of aplied torque to said hand wheel.

* * * * *